United States Patent [19]

Hasegawa

[11] Patent Number: 4,604,703

[45] Date of Patent: Aug. 5, 1986

[54] APPARATUS FOR CONTROLLING THE OPERATING STATE OF AN INTERNAL COMBUSTION ENGINE

[75] Inventor: Shumpei Hasegawa, Niiza, Japan

[73] Assignee: Honda Giken Kogyo Kabushiki Kaisha, Tokyo, Japan

[21] Appl. No.: 479,396

[22] Filed: Mar. 28, 1983

[30] Foreign Application Priority Data

Apr. 2, 1982 [JP] Japan ..... 57-55890

[51] Int. Cl.[4] ..... F02B 3/04; F02D 41/08; F02D 41/26; F02M 51/00

[52] U.S. Cl. ..... 364/431.07; 123/339; 123/480; 364/431.05

[58] Field of Search ..... 364/431.04, 431.05, 364/431.06, 431.07; 123/339, 480, 486

[56] References Cited

U.S. PATENT DOCUMENTS

| | | | |
|---|---|---|---|
| 4,010,717 | 3/1977 | Taplin | 123/492 |
| 4,257,377 | 3/1981 | Kinugawa et al. | 123/492 |
| 4,370,968 | 2/1983 | Nakatomi | 123/488 |
| 4,418,666 | 12/1983 | Yamauchi et al. | 123/339 |
| 4,424,568 | 1/1984 | Nishimura et al. | 364/431.05 X |
| 4,458,319 | 7/1984 | Chujo et al. | 364/431.06 |
| 4,469,064 | 9/1984 | Manaka et al. | 123/339 |
| 4,479,186 | 10/1984 | Takao et al. | 364/431.05 |

*Primary Examiner*—Felix D. Gruber
*Attorney, Agent, or Firm*—Pollock, VandeSande & Priddy

[57] ABSTRACT

An apparatus for controlling the operating state of the engine is disclosed. As a driving parameter, three absolute pressures in the intake manifold of the engine are sampled and detected. A first difference between a present sampling value and a preceding sampling value and a second difference between this preceding value and the two-times preceding value are obtained, respectively. The present sampling value is corrected using these first and second differences. The operating state of the engine is controlled in accordance with the corrected present sampling value. Thus, the engine can be stably driven thereby to provide an excellent driving performance. The present apparatus also contributes to purification of exhaust gases from the engine.

10 Claims, 12 Drawing Figures

APPARATUS FOR CONTROLLING THE OPERATING STATE OF AN INTERNAL COMBUSTION ENGINE

BACKGROUND OF THE INVENTION

The present invention relates to an apparatus for controlling the operating state of an internal combustion engine, and more particularly to an apparatus for controlling the operating state of an internal combustion engine in which a driving parameter of the internal combustion engine is detected and the operating state of the internal combustion engine is controlled in accordance with this detection output.

As one of the methods for controlling the operating state of an internal combustion engine (hereinafter referred to as an engine for simplicity) in an automobile or the like, there is known a method in which the quantity of the intake air per cycle of the cylinder is detected, and the quantity of the fuel injection of the engine is controlled in accordance with the amount of this intake air. This method is based upon the fact that there is approximately a linear relation between the quantity of the intake air and the absolute pressure $P_{BA}$ in the intake manifold (air suction pipe). This absolute pressure $P_{BA}$ is detected by a detecting apparatus such as a pressure sensor or the like. By using this detection output or the combination output of this detection output and another engine driving parameter, the fuel injection time $T_i$ is controlled in response thereto.

In this conventional method, the above-mentioned manifold absolute pressure $P_{BA}$ has to be the value representative directly of the manifold pressure in the suction process of the engine. However, in the case where $P_{BA}$ in each cycle is changing smoothly, it is actually possible to control the quantity of the fuel injection accurately by measuring the amount of the intake air in a given cycle by using the value $P_{BA}$ in the immediate preceding cycle, then injecting the fuel for the fuel injection time $T_i$ corresponding to the amount of the intake air thus obtained during the suction process or before this process.

On the other hand, in the case where the value $P_{BA}$ suddenly changes, for example, when the throttle is suddenly opened, there is a large difference between the measured value $P_{BA}$ representative of the present suction process and the measured value $P_{BA}$ representative of the preceding suction process. Therefore, there is a defect in the prior-art method in that the air fuel ratio is rarefied when the throttle is suddenly opened and it is condensed when the throttle is suddenly closed. To eliminate such a defect there is a method to correct the above-mentioned difference by using a throttle opening angle signal. However, even in this method, it is difficult to obtain a desired performance. The conventional method has also an adverse effect to purification of exhaust gases.

The present invention aims at resolution of such problems encountered in the conventional methods as mentioned above. The object is to provide an apparatus for controlling the operating state of an engine in which, even when the absolute pressure in the intake manifold suddenly changes, a stable driving state of the engine is secured and an excellent driving performance can be obtained, and which contributes to purification of exhaust gas.

SUMMARY OF THE INVENTION

In accordance with the present invention, there is provided an apparatus for controlling the operating state of the engine in which a detection output of the engine driving parameter is sampled at a certain sampling frequency; a difference between the sampling value at this time, or a present sampling value, and a previous sampling value which is obtained previously to the present sampling value is obtained; the value of the amount of change in the driving parameter in correspondence to the above-mentioned difference is added to the above-mentioned present sampling value to perform the correction; thereby the operating state of the engine is controlled using the modulated present sampling value.

BRIEF DESCRIPTION OF THE DRAWINGS

The invention will be better understood from the following description of a preferred embodiment, taken in conjunction with the accompanying drawings, in which.

DESCRIPTION OF A PREFERRED EMBODIMENT

Figure 1:
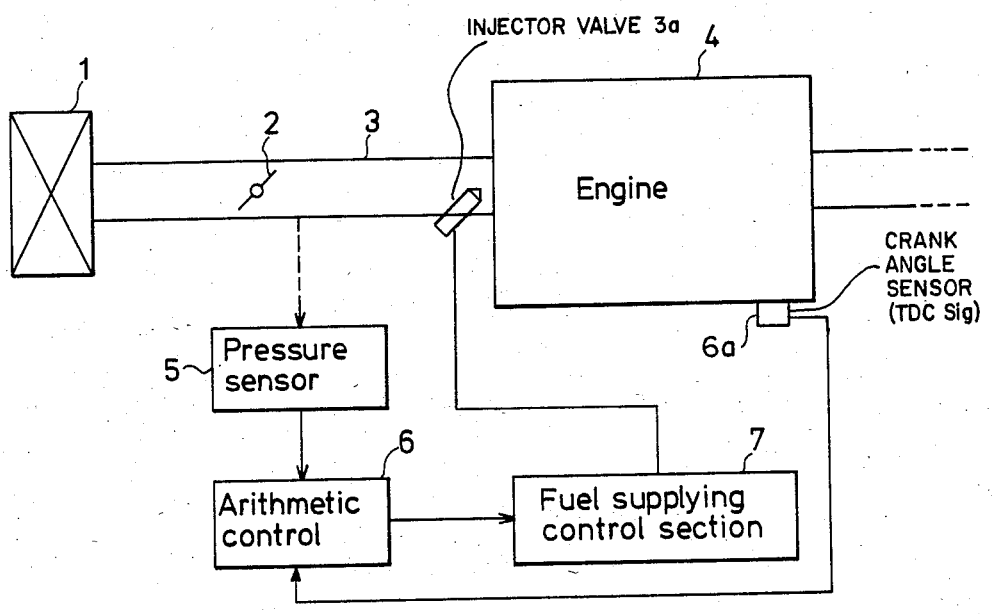
FIG. 1 is a schematic block diagram showing an embodiment of the present invention.

FIG. 1 shows a schematic block diagram of an apparatus for controlling the operating state of an engine of the present invention. The air passes through an air filter 1 and an intake manifold 3 having a throttle valve 2, then it is inhaled in an engine 4. The intake manifold 3 is provided with a pressure sensor 5 to measure the absolute pressure $P_{BA}$ in the intake manifold, which is one of the driving parameters of this engine. This pressure $P_{BA}$ is converted into an electric signal. This detection output is input to an arithmetic control 6 along with a TDC signal from crank angle sensor 6*a*. This circuit 6 comprises a microprocessor such as a microcomputer or the like, which performs the arithmetic processing in accordance with a predetermined program which will be described later. This arithmetic result is sent to a fuel supplying control section 7, which then supplies a control signal to the engine 4 to open a fuel injection valve 3*a* for a period in response to the result that is, an operating command or a desired operating condition. Hence, the quantity of the fuel injection, which is one of the operating command or desired condition, is controlled.

Figure 2:
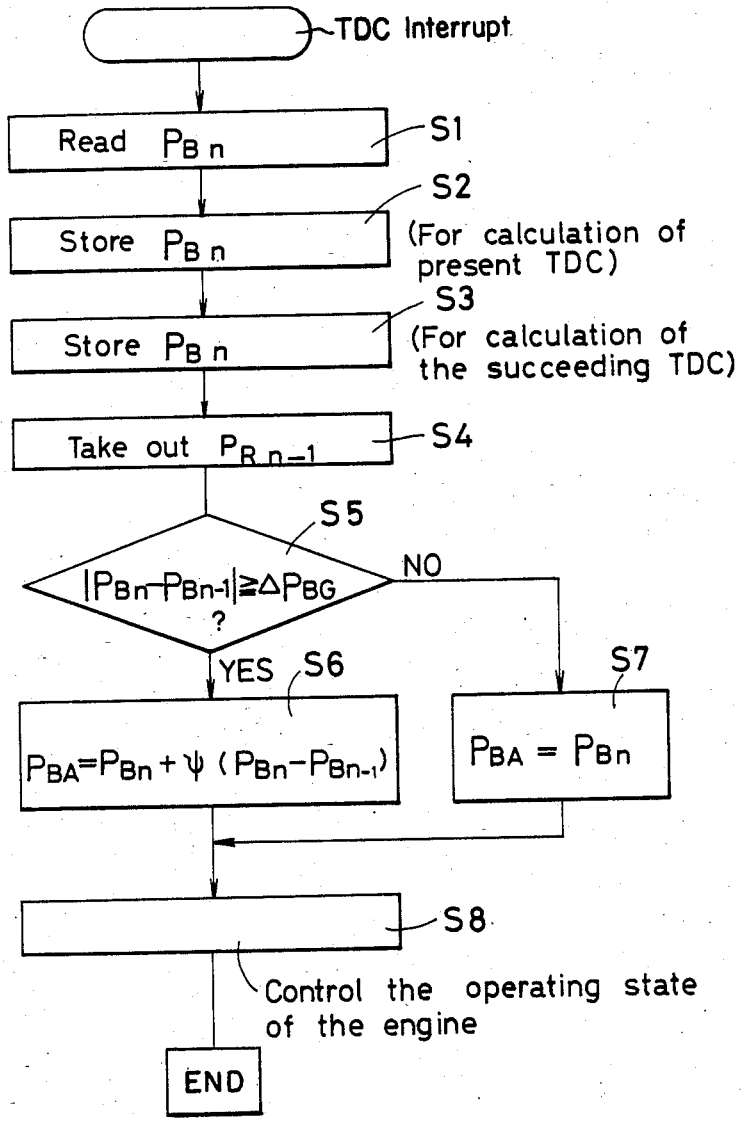
FIG. 2 is a flow chart illustrating a first example of a method for correcting a sampled engine parameter.
Figure 3:
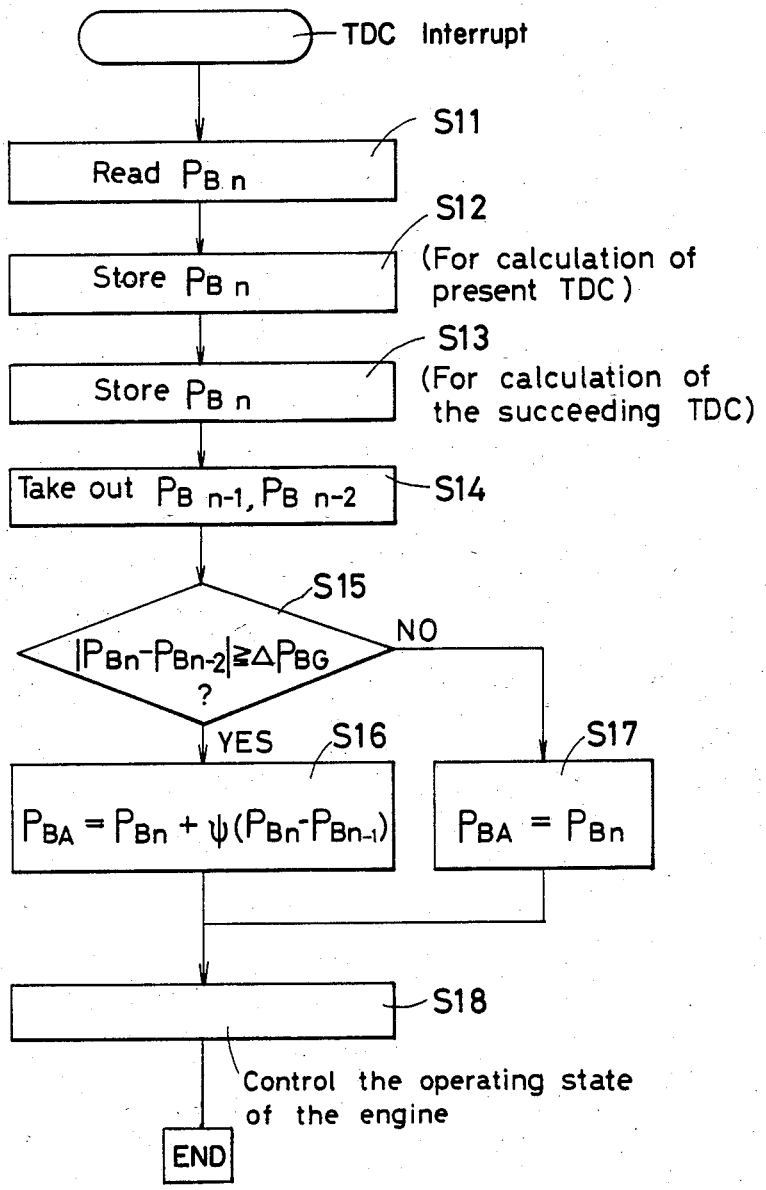
FIG. 3 is a flow chart illustrating a second example of a method for correcting a sampled engine parameter.
Figure 4:
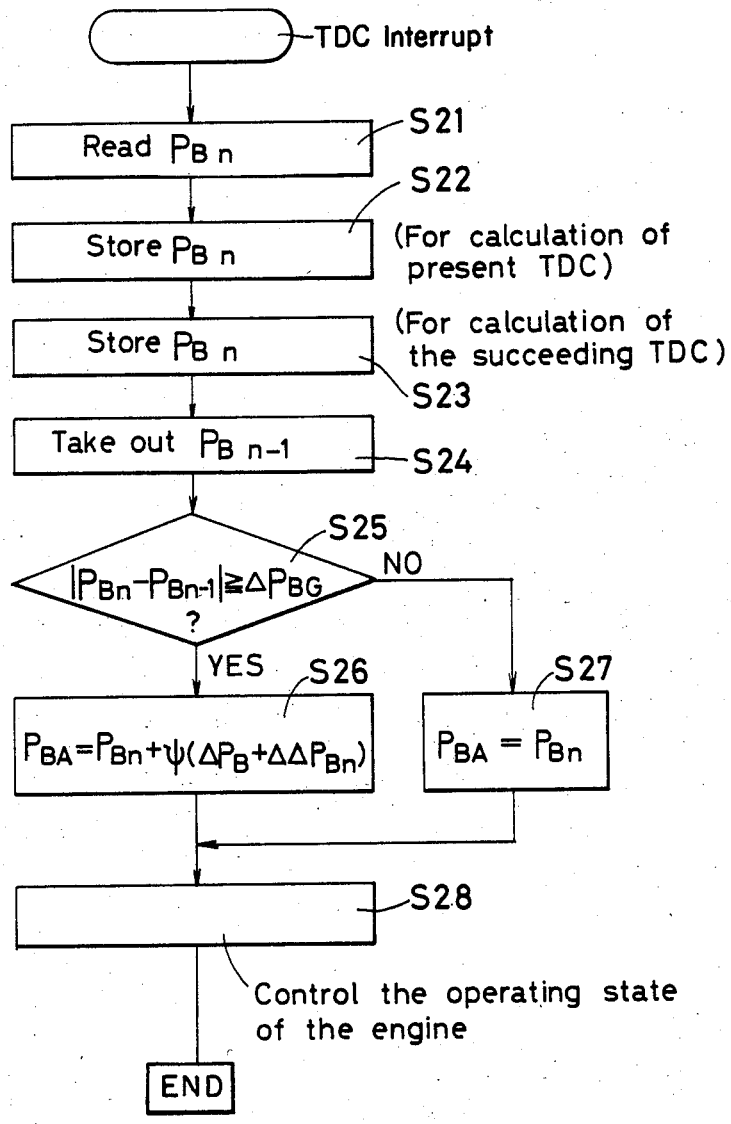
FIG. 4 is a flow chart illustrating a third example of a method for correcting sampled engine parameter.

FIGS. 2 to 4 are flowcharts showing examples of the control by the apparatus shown in FIG. 1.

Referring to FIG. 2, the absolute pressure $P_{BA}$ in the intake manifold 3 is detected by the pressure sensor 5 as described above, and the detection output corresponding to this absolute pressure $P_{BA}$ is sampled in the control circuit 6 at a certain sampling frequency synchronizing with a TDC (Top Dead Center) signal from sensor 6*a* (FIG. 1) which synchronizes with the rotation of the engine. Then the newest measured sampling value $P_{Bn}$ is read in step S1. This newest sampling value $P_{Bn}$ is memorized in an RAM (random Access Memory) in the control circuit as the data for the calculation in a TDC signal at this time, or a present TDC signal, in step S2. The sampling value $P_{Bn}$ is also stored in the RAM as the data for calculation in the TDC signal at the next time in step S3. Then, in step S4, the preceding sampling value $P_{Bn-1}$ is read out from the RAM, then the difference between the preceding sampling value $P_{Bn-1}$ and the newest sampling value $P_{Bn}$ at this time is calculated. The absolute value of this difference is checked in step S5 whether it is larger than or equal to a predetermined value $\Delta P_{BG}$ or not. The value $\Delta P_{BG}$ has a value of predetermined times of the unitary value constituting the absolute pressure $P_{BA}$, and it is referred to as a guard value hereinafter. If YES in step S5, namely only when $|P_{Bn}-P_{Bn-1}| \geqq \Delta P_{BG}$, the processing advances to step S6 and the newest sampling value $P_{BA}$ at this time is calculated and corrected so as to be $P_{Bn}+\Psi(P_{Bn}-P_{Bn-1})$, wherein $\Psi$ is a constant and an optimum value is selected in accordance with the various factors which will be described later. Next, in step S8, the fuel injection pulse width $T_i$ is determined in correspondence to this correction value, thereby controlling the quantity of the fuel injection which is one of the operating conditions of the engine.

If NO in step S5, that is to say, when $|P_{Bn}-P_{Bn-1}| < \Delta P_{BG}$, the newest sampling value $P_{Bn}$ at this time is not corrected but used as it is as the fixed quantity of the fuel injection pulse width similarly in the conventional manner. In other words, the processing advances to step S7, where it is determined that $P_{BA}=P_{Bn}$, then step S8 follows.

As described above, these steps S1 to S8 are sequentially repeated in order to perform the proper control of the operating state of the engine.

The function in such a method for controlling the operating state of the engine as described above with respect to FIG. 2 is now explained in detail hereinbelow. When the change amount of the absolute pressure $P_{BA}$ in the manifold in the sampling period is large, $|P_{Bn}-P_{Bn-1}| \geqq P_{BG}$. Thus, the value $\Psi(P_{Bn}-P_{Bn-1})$ corresponding to this change amount (including the sign and the magnitude) is added to the newest sampling value $P_{Bn}$ at this time to determine the value of $P_{BA}$. Therefore, when $P_{BA}$ increases, the value of $P_{BA}$ is preliminarily corrected and increased in response to the increased amount of the change. When $P_{BA}$ reduces, on the other hand, the value of $P_{BA}$ is preliminarily corrected and reduced according to the reduced amount of the change. Hence, it is possible to correct the delay in the operation of the control system such as the sensor 5, the arithmetic control 6, or the like and the delay in the operation of the controlled system of the engine 4. That the air fuel ratio is rarefied and condensed, which is a defect in the prior-art apparatus, is prevented. The apparatus of the present invention contributes to the purification of exhaust gas. The constant $\Psi$ for multiplication in the above-mentioned correction is determined in consideration of the delays in these systems or the like.

Referring to FIG. 3, steps S11 to S13 and S16 to S18 are the same as steps S1 to S3 and S6 to S8 in FIG. 2, so the processing in these steps will not be described any more for simplicity. Only the different steps will be explained below. In FIG. 3, the sampling value $P_{Bn-2}$ which is two times before the sampling value at this time is also used. That is, in step S14, both the preceding sampling value $P_{Bn-1}$ and the above-mentioned sampling value $P_{Bn-2}$ are fetched. Then, in step S15, the absolute value $|P_{Bn}-P_{Bn-2}|$ is checked whether it is larger than or equal to $\Delta P_{BG}$ in order to discriminate about the necessity of correction of the sampling value at this time. If YES in step S15, the processing advances to step S16 and S18. If NO, step S17 follows. As described in FIG. 2, the processing in steps S11 to S18 is repeated to control the operating state of the engine.

In this second example, the amount of the change in $P_{BA}$ is detected by using the difference between the sampling value at this time and the two-time-preceding sampling value. Thus, the more stable parameter value can be detected as compared with the discriminating method in FIG. 2. Namely, in FIG. 2, unnecessary correction may be performed since, in the case where the guard value is set to a value corresponding to the minimum resolution, the quantizing error in the sampling value may be mistaken for the change amount between the sampling value at this time and the preceding one.

Referring now to FIG. 4, steps S21 to 25, S27, and S28 are the same as steps S1 to S5, S7, and S8 in FIG. 2, respectively. Only the processing in step S26 is different from step S6. That is to say, the arithmetic expression to obtain the correction value $P_{BA}$ is expressed by $$P_{BA}=P_{Bn}+\Psi(\Delta P_{Bn}+\Delta\Delta P_{Bn}),$$

wherein $\Delta P_{Bn}=P_{Bn}-P_{Bn-1}$ and $\Delta\Delta P_{Bn}=\Delta P_{Bn}-\Delta P_{Bn-1}$. According to this arithmetic correction, it is obvious that the accuracy in correction is improved as compared with the method of FIG. 2. In this example, the value $\Psi$ is determined in response to the delay in the operations of the control system and the controlled system, or the like.

The apparatus of the invention is activated by synchronizing with the TDC signal with respect to the abovedescribed programs shown in FIGS. 2 to 4; however, it may be activated with a desired fixed period.

In the range where the engine rotating speed is larger, in which there is few problems in the hunting of the engine rotating speed, it may be possible to use the sampling value at this time as it is in the calculation processing in order to reduce the calculating time in case of activating the program by synchronizing with the TDC signal using a microcomputer. A large constant $\Psi$ can be set while in the idling drive at which the hunting of the engine rotating speed can be easily sensed by a driver, for example, in the case where the idling drive is discriminated by the low engine rotating speed and the full closure of the throttle valve. A small constant Ψ may be set in case of other than the idling drive, and particularly it is set to zero when no problem on hunting occurs that is during an engine operating state other than the idling drive.

It may be possible to vary the value of constant Ψ depending upon the sign of the difference between the sampling value at this time and the preceding sampling value, namely upon a change in the driving parameter in the accelerating and decelerating directions of the engine.

Figure 5:
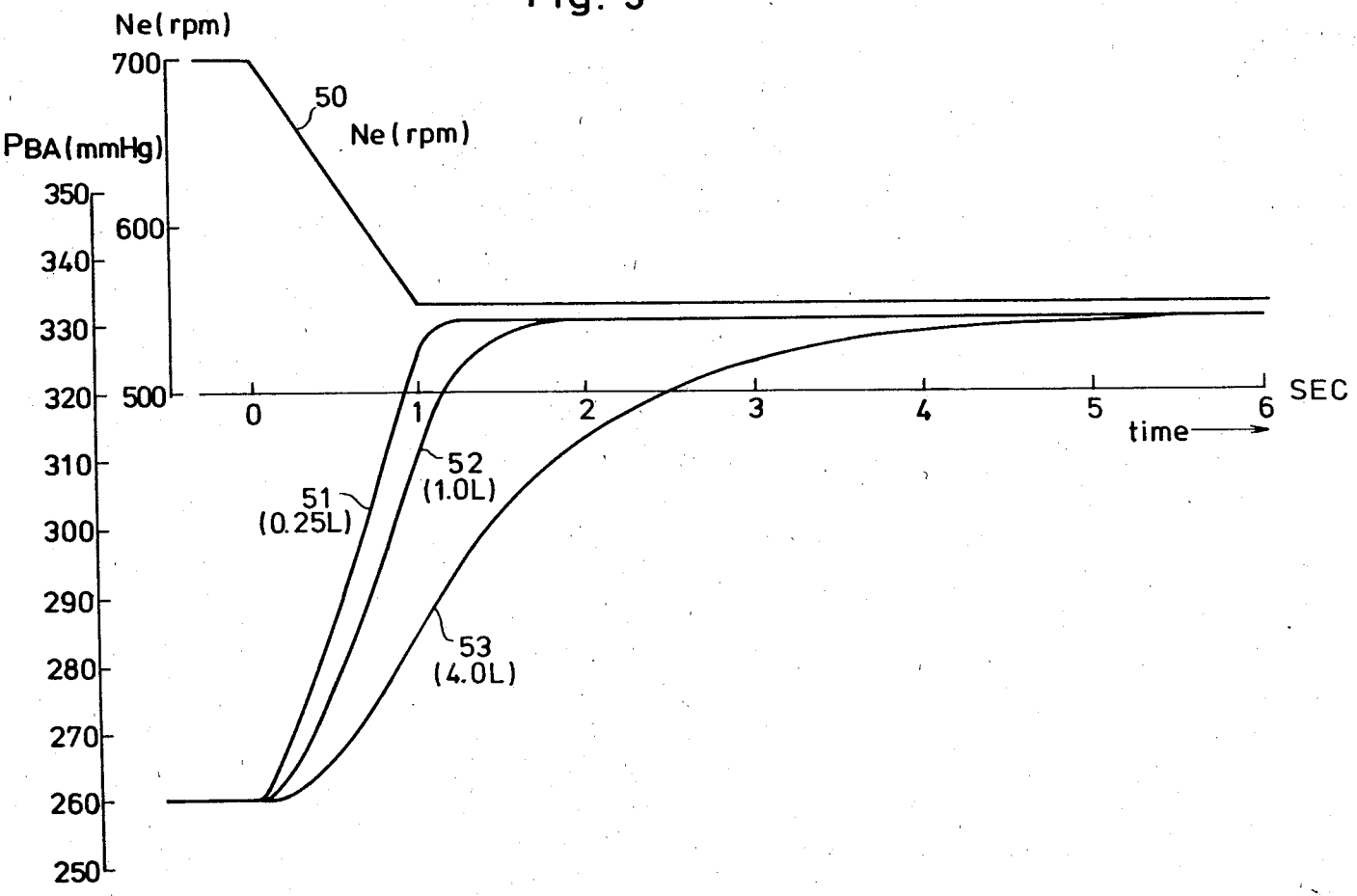
FIG. 5 is a plot of the follow-up characteristic of absolute pressure in an engine manifold where a load changes as a step function.
Figure 6:
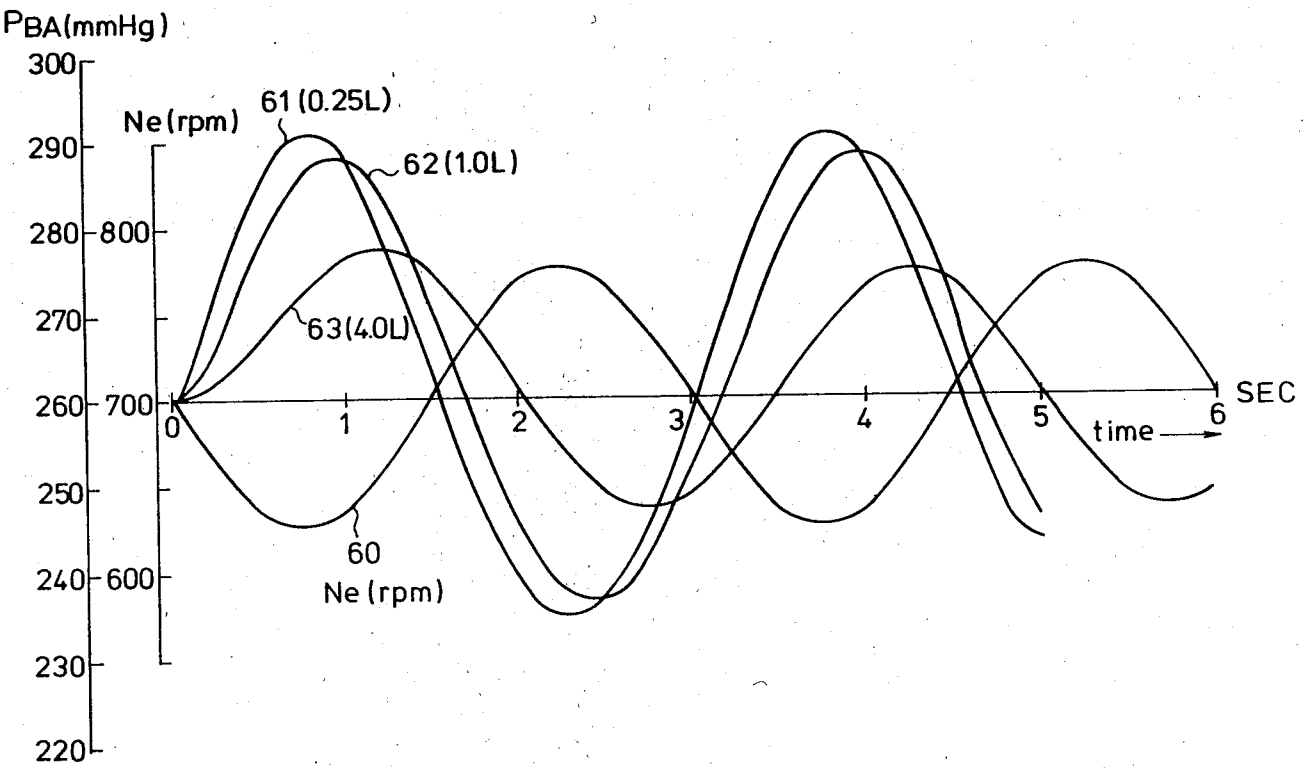
FIG. 6 is a plot of the follow-up characteristic of absolute pressure in an engine manifold where a load changes in a sinusoidal manner.

The effect of the present invention will be described with reference to FIGS. 5 to 12. FIG. 5 shows the follow-up characteristic of the absolute pressure $P_{BA}$ in the manifold in the case where a load functions on a step by step basis while in the idling of the engine. A curve 50 shows a change in the engine rotating speed to the time. Curves 51 to 53 respectively indicate changes in $P_{BA}$ to the time in each case where the volumes in the manifold are 0.25, 1.0 and 4.0 liters. FIG. 6 shows the state of a follow-up change in absolute pressure $P_{BA}$ to a sine-wave-like change (a curve 60) in the rotating speed while in the idling of the engine. Curves 61 to 63 respectively show changes in each case where the volumes in the manifold are 0.25, 1.0 and 4.0 liters.

Figure 7:
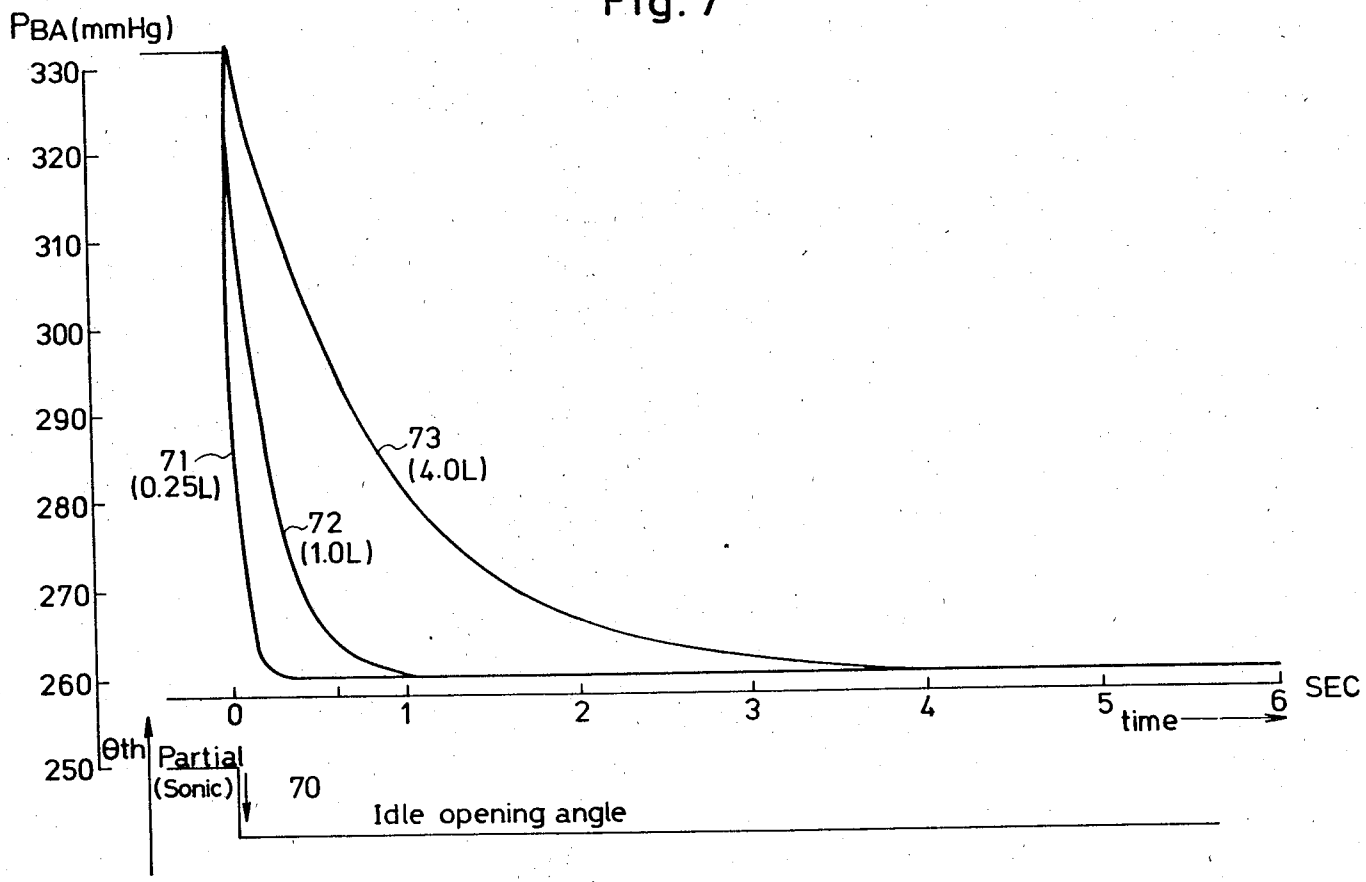
FIG. 7 is a plot of the follow-up characteristic of absolute pressure in an engine manifold when the throttle is closed suddenly.

FIG. 7 shows the follow-up characteristic of $P_{BA}$ when the throttle is closed suddenly. A curve 70 indicates a change in opening angle of the throttle and curves 71 to 73 respectively show the follow-up characteristics in each case where the volumes in the manifold are 0.25, 1.0 and 4.0 liter.

Figure 8:
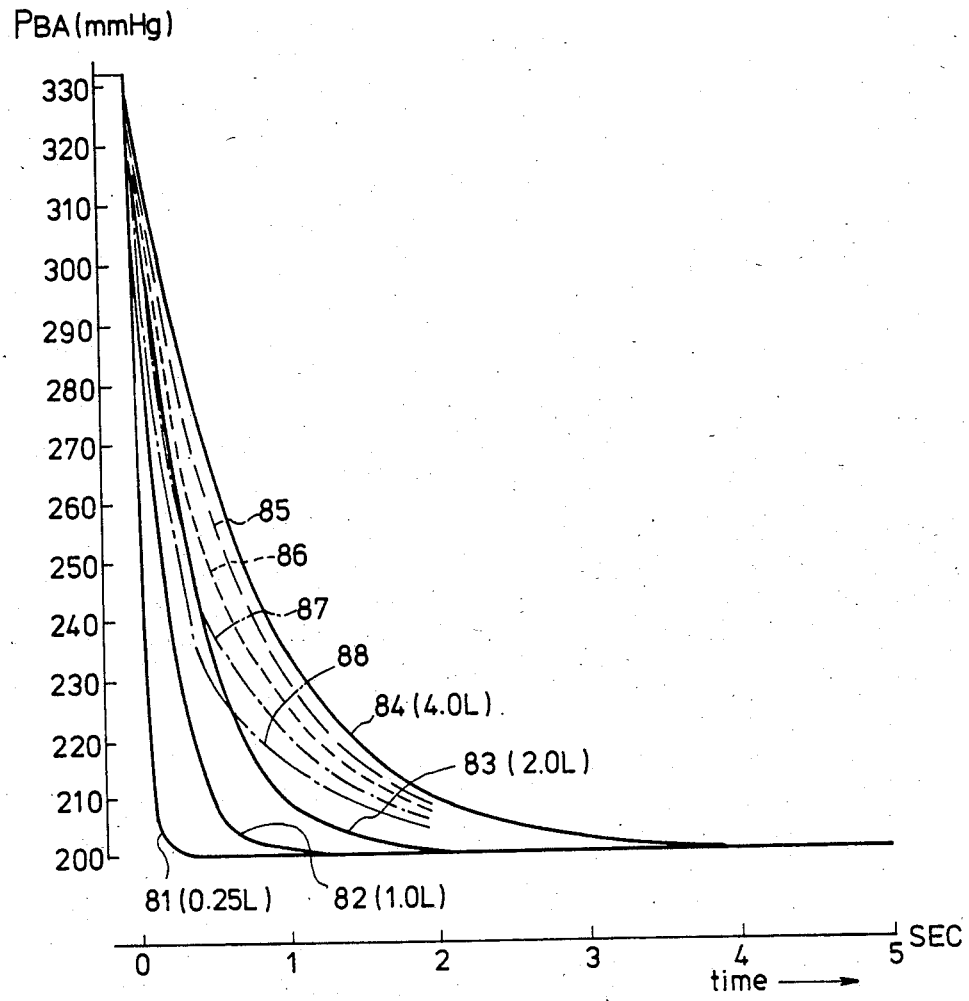
FIG. 8 is a plot showing the effect of the present invention when the throttle is closed suddenly.

As will be seen from FIGS. 5 to 7, the absolute pressure $P_{BA}$ in the manifold follows up the changes in the engine rotating speed and the throttle opening angle with some delay, and this delay becomes larger with an increase in the volume in the manifold. This delay time is corrected by the present invention. FIG. 8 shows the correction state.

In FIG. 8, there is shown the effect of the invention when the throttle is closed suddenly. Curves 81 to 84 respectively indicate the change characteristics of the absolute pressure $P_{BA}$ to the time in each case where the volumes are 0.25, 1.0, 2.0 and 4.0 liters in the case where the present invention is not employed. Curves 85 and 86 indicated by broken lines and curves 87 and 88 indicated by alternate long and short dash lines respectively show the follow-up characteristics of $P_{BA}$ to the time in each case where $\Psi=2$, 4, 6, and 8 in the case where the invention is employed to the manifold having the volume of 4.0 liters. It will be understood that even in the manifold having the volume of 4.0 liters, the above-mentioned characteristic is remarkably improved since the absolute pressure $P_{BA}$ after correction corresponds to the manifold having the volume of 2.0 liter by setting the value Ψ to 4–6, especially.

Figure 9:
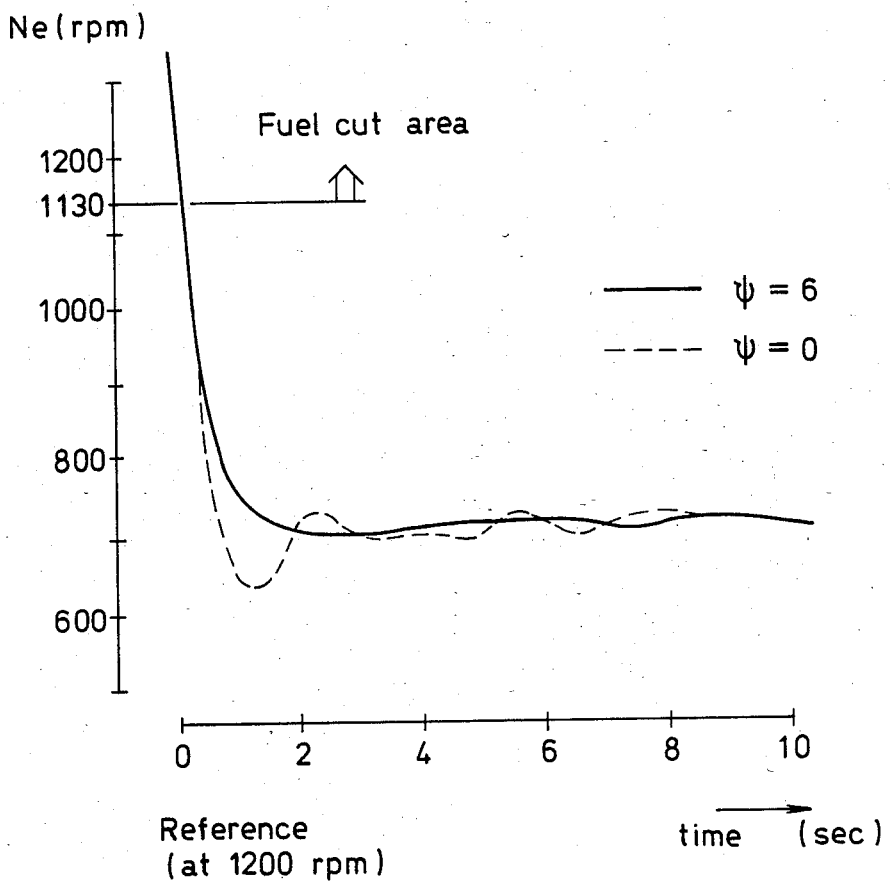
FIG. 9 is a plot illustrating another example of the follow-up characteristic which describes the effect of the present invention.

FIG. 9 shows another example of the characteristic for describing the effect of the present invention. There is shown a relation between a constant Ψ and the reduction in engine rotating speed when the clutch is set to OFF. This graph discloses the correcting operation of the present invention when he cruising speed is reduced from 3000 rpm at second gear and the clutch is set to OFF at 1300 rpm. The fuel injection is cut off at speeds over 1130 rpm. In FIG. 9 a solid line indicated a change in engine rotating speed when $\Psi=6$. A broken line indicates a change in rotating speed when $\Psi=0$, namely when the present invention is not employed. It will be seen that the hunting in rotating speed is suppressed according to the present invention and the engine rotating speed coverges into approximately a proper range of idling rotating speed. The hunting in rotating speed is caused by the operation of the AC generator for charging the battery.

Figure 10:
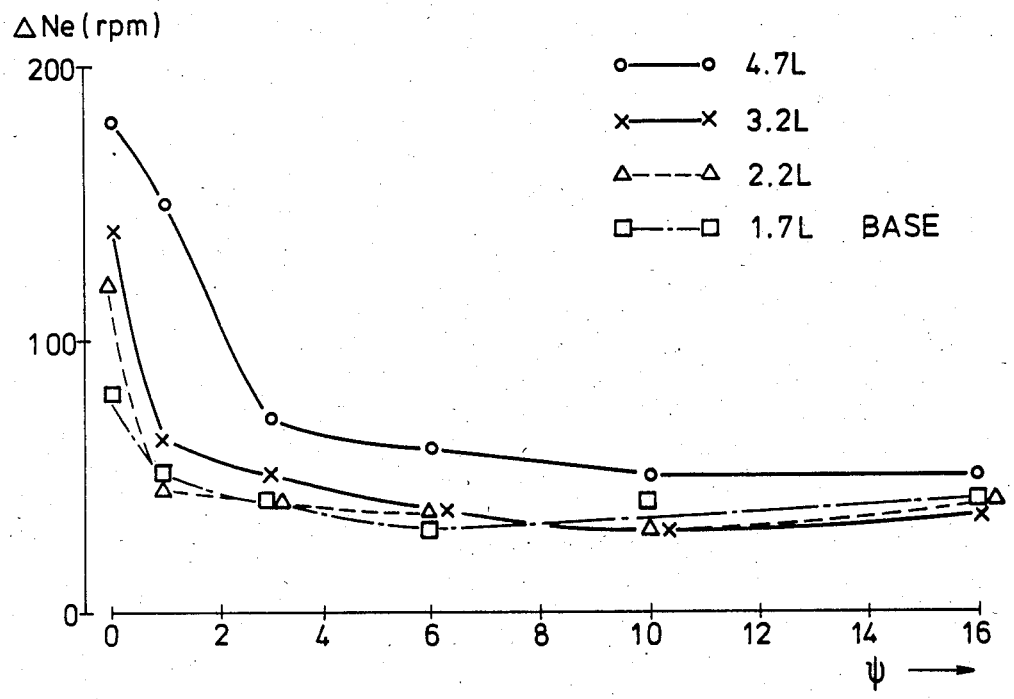
FIG. 10 is a plot illustrating a relationship between a correction constant and maximum change within hunting, in a certain driving state during idling.

FIG. 10 shows a relationship between a constant Ψ and the maximum change width in hunting ΔNe (rpm) in a certain driving state during idling (i.e. in the state that the hunting easily occurs). Each curve indicates the characteristics when volumes in the manifold are 1.7, 2.2, 3.2, and 4.7 liters, respectively. It will be understood from FIG. 10 that the suitable selection of the value of Ψ causes the hunting to be suppressed. It has been confirmed that the hunting can be effectively suppressed even when the value of Ψ is about 2.

Figure 11:
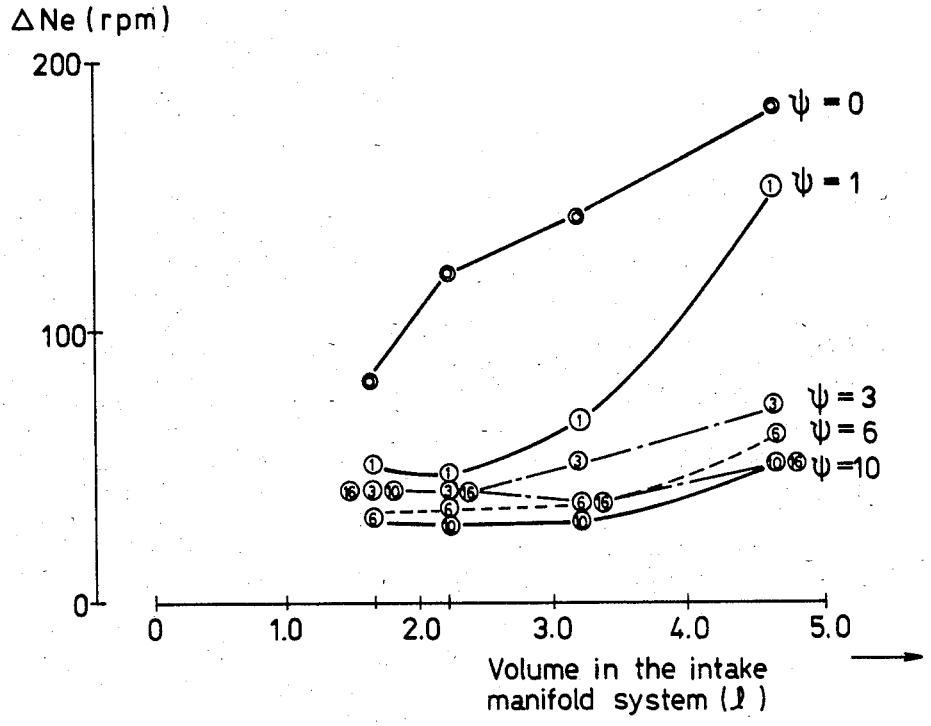
FIG. 11 is a plot illustrating the relationship between the intake manifold volume and the maximum change in engine rotating speed.

FIG. 11 shows a relation between the volume in the intake manifold and the maximum change amount in engine rotating speed ΔNe. Each curve indicates the characteristics when the values of constant Ψ are 0, 1, 3, 6, 10, and 16, respectively. These characteristics are obtained under the same condition as FIG. 10. It is obvious that the hunting can be effectively suppressed by suitably selecting the value of Ψ independent of the volume in the manifold.

Figure 12:
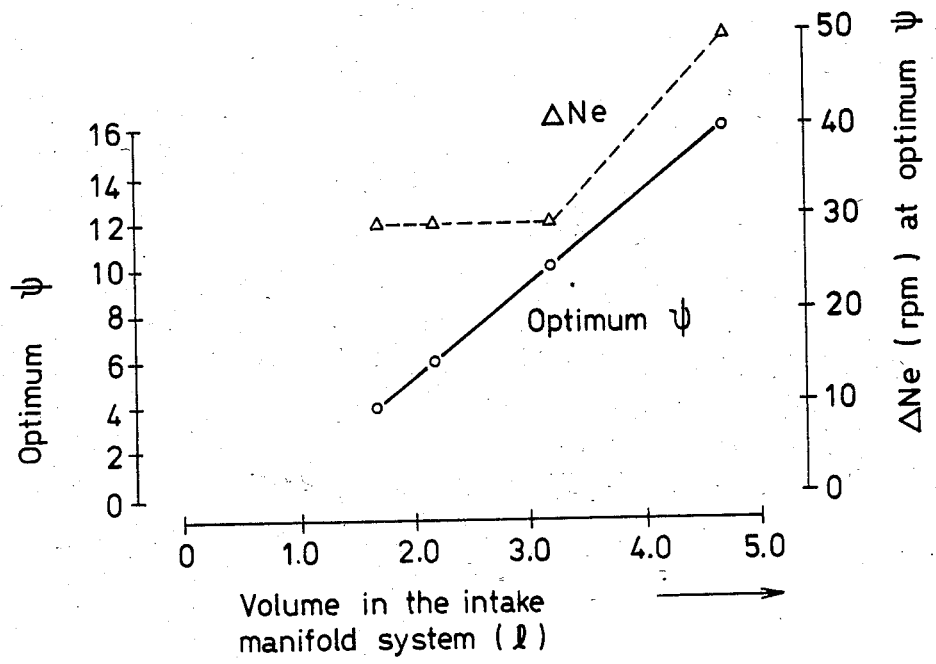
FIG. 12 is a plot illustrating the relation between the optimum correction constant with respect to the volume in the intake manifold and engine rotating speed.

FIG. 12 shows a relation between the optimum constant Ψ with respect to the volume in the intake manifold and the engine rotating speed ΔNe (rpm) in this optimum Ψ. It will be seen from this figure that it is preferable to increase the value of Ψ with an increase in the volume in the manifold. This means that since the operation of the controlled system delays largely as the volume in the manifold increases, a larger amount of correction is obtained by adopting a larger value of the constant Ψ for correction multiplication Each of the above-described characteristic data with respect to FIGS. 5 to 12 is obtained in accordance with the processings shown in the flowchart of FIG. 2. There is no need to say that substantially the same effect can be derived using the flowcharts shown in FIGS. 3 and 4. In the above-mentioned embodiments, the absolute pressure in the manifold is detected as a driving parameter of the engine and thereby controls the injection pulse width; however, the present invention is not limited to this. It will be obvious to those skilled in the art that various modifications can be made in the present method and apparatus described herein without departing from the spirit and scope of the invention which is limited only by the appended claims.

As described above, according to the present invention, the stable driving characteristic of the engine can be obtained. This contributes to purification of exaust gas.

What is claimed is:

1. A method for controlling an internal combustion engine which operates in accordance with an operating command and comprising the steps:

producing a parameter signal representative of an engine parameter of said internal combustion engine;

sampling said parameter signal at a sampling frequency so as to produce successively appearing sample signals;

storing said sample signals;

producing a subtraction signal representative of a difference in magnitude between a latest sample signal and a one-time preceding sample signal having appeared one-time before said latest sample signal;

comparing said subtraction signal with a predetermined value so as to produce a correction command signal when said subtraction signal exceeds said predetermined value;

correcting said latest sample signal by adding thereto an additive signal related to said subtraction signal under the existence of said correction command signal; and establising said operating command for the engine in response to the corrected latest sample signal.

2. A method according to claim 1, in which said operating command is related to the fuel supply rate to said internal combustion engine.

3. A method according to claim 2, in which all the steps operate in synchronism with engine rotation of said internal combustion engine and said internal combustion engine is equipped with a fuel injector triggered upon the completion of the operating command to inject fuel during a time period according to said operating command.

4. A method according to claim 1, in which said additive signal is proportional to said subtraction signal at a rate according to the total operation period of all said steps and/or the repetition period of engine cycle of said internal combustion engine.

5. The method of claim 1 which includes the further steps of:

producing a second substraction signal representative of a difference in magnitude beween a one-time preceding sample signal and a two-times preceding sample signal, producing a correction signal representative of the difference in magnitude between said subtraction signal and said second subtraction signal, and increasing said additive signal by said correction signal.

6. The method of claim 5 in which said correcting step corrects said latest sample by a product of said additive signal and a constant $\Psi$.

7. The method of claim 6 in which said constant $\Psi$ is related to engine speed.

8. The method of claim 7 in which said constant $\Psi$ is larger at low or idling speed and lower at other speeds.

9. A method for controlling an internal combustion engine which operates in accordance with an operating command, and which comprises the steps of:

producing a parameter signal representative of an engine parameter of said internal combustion engine;

sampling said parameter signal at a sampling frequency so as to produce successively appearing sample signals;

storing said sample signals;

producing a first subtraction signal representative of a difference in magnitude between a latest sample signal and a two-times preceding sample signal having appeared two-times before said latest sample signal;

comparing said first subtraction signal with a predetermined value so as to produce a correction command signal when said first subtraction signal exceeds said predetermined level;

producing a second subtraction signal representative of a difference in magnitude between a latest sample signal and a one-time preceding sample signal appearing one time before said latest sample signal;

correcting said latest sample signal by adding an additive signal related to said second subtraction signal under the existence of said correction command signal; and establishing said operating command for the engine in response to the corrected latest sample signal.

10. A method for controlling an internal combustion engine which operates in accordance with an operating command, and which comprises the steps:

producing a parameter signal representative of an engine parameter of said internal combustion engine;

sampling means for sampling said parameter signal at a sampling frequency so as to produce successively appearing sample signals;

storing said sample signals;

producing a first subtraction signal representative of a first difference in magnitude between a latest sample signal and a one-time preceding sample signal;

producing a second subtraction signal representative of a second difference in magnitude between said one-time preceding sample signal and a two-time preceding sample signal;

producing a third subtraction signal representative of a third difference in magnitude between said first and second differences;

comparing said first subtraction signal with a predetermined value so as to produce a correction command signal when said first subtraction signal exceeds said predetermined value;

correcting said latest sample signal by adding thereto an additive signal related to an addition of said first and third subtraction signals under the existence of said correction command signal; and establishing said operating command for the engine in response to the corrected latest sample signal.

* * * * *